US005959167A

United States Patent [19]

Shabtai et al.

[11] Patent Number: 5,959,167

[45] Date of Patent: Sep. 28, 1999

[54] PROCESS FOR CONVERSION OF LIGNIN TO REFORMULATED HYDROCARBON GASOLINE

[75] Inventors: Joseph S. Shabtai; Wlodzimierz W. Zmierczak, both of Salt Lake City, Utah; Esteban Chornet, Golden, Colo.

[73] Assignee: The University of Utah Research Foundation, Salt Lake City, Utah

[21] Appl. No.: 09/136,336

[22] Filed: Aug. 19, 1998

Related U.S. Application Data

[60] Provisional application No. 60/056,785, Aug. 25, 1997.

[51] Int. Cl.[6] ..... C10G 1/00; C07C 1/00

[52] U.S. Cl. ..... 585/242; 585/254; 585/317; 585/319; 585/469; 585/930; 585/240

[58] Field of Search ..... 585/242, 254, 585/317, 319, 357, 469, 733, 930, 940, 240

[56] References Cited

U.S. PATENT DOCUMENTS

| | | | |
|---|---|---|---|
| H1305 | 5/1994 | Townsend et al. | 44/449 |
| 4,647,704 | 3/1987 | Engel et al. | 568/716 |
| 4,728,418 | 3/1988 | Shabtai et al. | 208/413 |
| 5,095,167 | 3/1992 | Christensen | 585/720 |
| 5,135,639 | 8/1992 | Schmidt et al. | 208/66 |
| 5,191,146 | 3/1993 | Gajda et al. | 585/667 |
| 5,196,626 | 3/1993 | Child et al. | 585/720 |
| 5,235,120 | 8/1993 | Bogdan et al. | 585/253 |
| 5,243,121 | 9/1993 | Madon et al. | 585/649 |
| 5,294,328 | 3/1994 | Schmidt et al. | 208/66 |
| 5,336,831 | 8/1994 | Gajda et al. | 585/667 |
| 5,365,008 | 11/1994 | Barger et al. | 585/667 |
| 5,367,101 | 11/1994 | Lawson et al. | 585/667 |
| 5,382,350 | 1/1995 | Schmidt | 208/65 |
| 5,401,385 | 3/1995 | Schmidt et al. | 208/57 |
| 5,478,366 | 12/1995 | Teo et al. | 44/301 |
| 5,498,810 | 3/1996 | Bogdan et al. | 585/310 |
| 5,504,259 | 4/1996 | Diebold et al. | 568/697 |
| 5,516,960 | 5/1996 | Robinson | 585/639 |
| 5,578,090 | 11/1996 | Bradin | 44/308 |
| 5,583,275 | 12/1996 | Kranz et al. | 585/709 |
| 5,593,567 | 1/1997 | Jessup et al. | 208/46 |
| 5,648,586 | 7/1997 | Sampath | 585/716 |
| 5,653,866 | 8/1997 | Jessup et al. | 208/46 |
| 5,705,722 | 1/1998 | Monnier et al. | 585/240 |
| 5,713,965 | 2/1998 | Foglia et al. | 44/388 |
| 5,735,916 | 4/1998 | Lucas et al. | 44/605 |

OTHER PUBLICATIONS

Shabtai et al., Catalytic Functionalities of Supported Sulfides, Journal of Catalysis, 104, 413–423, 1987.

(List continued on next page.)

*Primary Examiner*—Bekir L. Yildirim
*Attorney, Agent, or Firm*—Workman, Nydegger & Seeley; Gregory M. Taylor

[57] ABSTRACT

A process for converting lignin into high-quality reformulated hydrocarbon gasoline compositions in high yields is disclosed. The process is a two-stage, catalytic reaction process that produces a reformulated hydrocarbon gasoline product with a controlled amount of aromatics. In the first stage, a lignin material is subjected to a base-catalyzed depolymerization reaction in the presence of a supercritical alcohol as a reaction medium, to thereby produce a depolymerized lignin product. In the second stage, the depolymerized lignin product is subjected to a sequential two-step hydroprocessing reaction to produce a reformulated hydrocarbon gasoline product. In the first hydroprocessing step, the depolymerized lignin is contacted with a hydrodeoxygenation catalyst to produce a hydrodeoxygenated intermediate product. In the second hydroprocessing step, the hydrodeoxygenated intermediate product is contacted with a hydrocracking/ring hydrogenation catalyst to produce the reformulated hydrocarbon gasoline product which includes various desirable naphthenic and paraffinic compounds.

40 Claims, 4 Drawing Sheets

OTHER PUBLICATIONS

Shabtai et al., Catalytic Functionalities of Supported Sulfides, Journal of Catalysis, 113, 206–219, 1988.

Shabtai and Zhang, Low Temperature Coal Depolymerization–Liquefaction: Conversion of a North Dakota Lignite to a Light Hydrocarbon Oil, Proceedings vol. II, 1989 International Conference on Coal Science, Tokyo, Japan, Oct. 1989.

Albright, Alkylation Will be Key Process in Reformulated Gasoline Era, Oil and Gas Journal, 79–92, Nov. 1990.

Proceedings of 9th International Congress on Catalysis, Calgary, Canada 1988, vol. 1, pp. 1–10.

PROCESS FOR CONVERSION OF LIGNIN TO REFORMULATED HYDROCARBON GASOLINE

This application claims the benefit of priority to U.S. Provisional Application No. 60/056,785, filed on Aug. 25, 1997, the disclosure of which is herein incorporated by reference.

The U.S. Government has a paid-up license in this invention and the right in limited circumstances to require the patent owner to license others on reasonable terms as provided for by the terms of Grant No. XAC-5-14411-01 awarded by the National Renewable Energy Lab and Grant No. AU-8876 and Amendment 1 awarded by Sandia National Labs (DOE Flowthru).

BACKGROUND OF THE INVENTION

1. The Field of the Invention

The present invention is related generally to processes for converting biomass to gasoline products. More specifically, the present invention is related to a catalytic process for production of reformulated hydrocarbon gasoline from lignin.

2. The Relevant Technology

The growing pollution problems in this country and around the world are associated to a significant extent with undesirable side reactions during combustion of currently usedfuels including gasolines and jet fuels. Conventional gasoline products were characterized in the past by a major proportion of aromatic hydrocarbon components, which, upon combustion, yield unacceptably large amounts of carbon monoxide and health-endangering levels of polycyclic carcinogens. The need for reformulation of gasoline, ie., a significant change in the chemical composition of gasoline, has been recognized through a 1990 amendment of the Clean Air Act, which requires a lowering in the total aromatic content of gasoline to a maximum of 25 weight percent (wt-%), and a lowering in the concentration of a particular, strongly carcinogenic component, benzene, down to a level of less than 1 wt-%. Furthermore, the same amendment requires that the oxygen content of reformulated gasoline should be 2.0 wt-% or greater.

Reformulated gasoline compositions having somewhat lower concentrations of aromatic components, which are cleaner burning and markedly more environment-friendly than conventional current gasolines, are thus needed in order to comply with the Clean Air Act.

Recently patented processes concerned with petroleum-based reformulated gasoline compositions use several well-defined types of chemical reactions, including (a) alkylation of $C_3$ to $C_5$ olefins with branched $C_4$ and $C_5$ paraffins to produce higher branched paraffins in the gasoline boiling range; (b) skeletal isomerization of normal $C_4$ and $C_5$ olefins to produce branched $C_4$ and $C_5$ olefins, i.e., olefins containing tertiary carbons, which are needed for subsequent use in the production of appropriate ethers as additives for reformulated gasolines; (c) ring hydrogenation of aromatic hydrocarbons to reduce the aromatic content of naphthas and gasoline blends; (d) skeletal isomerization of normal paraffins to produce branched paraffins in the gasoline boiling range; and (e) etherification reactions of branched olefins to produce alkyl t-alkyl ethers, e.g., methyl t-butyl ether, ethyl t-butyl ether; methyl t-pentyl ether, and others, which are useful as oxygenated components of reformulated gasolines. In some of the below described patents there is either coordination or sequential application of two or more of the above types of reactions to produce desirable components for reformulated gasolines.

An example of a process for production of alkylates is provided by U.S. Pat. No. 5,583,275 to Kranz et al., which describes an alkylation process comprising interaction of $C_3$ to $C_5$ olefins with an isoparaffin mixture of isobutane and isopentane in the presence of an acidic catalyst. The alkylate product consists of branched paraffins in the gasoline boiling range, suitable as blending components for reformulated gasoline. A similar alkylation process comprising reaction of isobutane with pentenes in the presence of sulfuric acid as catalyst is described in U.S. Pat. No. 5,648,586 to Sampath.

Another type of improved process for production of blending components for reformulated gasoline comprises skeletal isomerization of $C_4$ to $C_6$ normal olefins to $C_4$ to $C_6$ branched olefins, which contain desirable tertiary carbons, followed by etherification of such $C_4$ to $C_6$ branched olefins to yield alkyl t-alkyl ethers. Such ethers have been previously found to act as highly efficient oxygenated additives to reformulated gasoline compositions. Examples of such sequential isomerization-etherification processes include U.S. Pat. No. 5,367,101 to Lawson et al., which describes an improved process for isomerization of normal pentenes into branched pentenes in the presence of a non-zeolitic molecular sieve. The produced branched pentene can be subsequently etherified to produce methyl t-pentyl ether which can be used as a blending component of reformulated gasoline. In U.S. Pat. No. 5,365,008 to Barger et al., an improved process is disclosed for skeletal isomerization of normal butenes and/or pentenes to produce branched butenes and/or branched pentenes in the presence of a silicoaluminophosphate molecular sieve containing noncondensed silica. The produced branched butenes and/or pentenes contain desirable tertiary carbons and can be further processed to obtain alkyl t-butyl and/or alkyl t-pentyl ethers useful as blending components for reformulated gasolines. Similar processes, comprising skeletal isomerization of normal $C_4$ to $C_6$ olefins to corresponding branched $C_4$ to $C_6$ olefins to subsequently produce alkyl t-alkyl ethers, have been described in U.S. Pat. No. 5,191,146 to Gajda et al.

In another series of patents there are disclosures of various process combinations for production of reformulated gasolines or blending components for such gasolines. For example, U.S. Pat. No. 5,135,639 to Schmidt et al. discloses a process comprising a reduction in the aromatic content of gasoline blending components and skeletal isomerization of normal paraffins to desirable branched paraffins. The stepwise process comprises (a) reducing the severity of naphtha reforming with concomitant reduction in paraffin aromatization and cracking, and (b) extensive isomerization of the low-octane paraffinic components of the reformate. A Group VIII metal, for example Pt, on a refractory support, is used as catalyst in the mild reforming step of the process (step a), whereas various isomerizing catalyst systems, e.g., a Pt-group metal in combination with an acidic aluminosilicate, or in combination with a metal halide, are used in the isomerization of the low-octane fraction of the reformate (step b). Ultimately, a reformulated gasoline composition is produced by blending a fraction containing an appropriate concentration of aromatics with isomerized light and heavy paraffinic fractions. A similar process is disclosed in U.S. Pat. No. 5,294,328 to Schmidt et al.

In U.S. Pat. No. 5,401,385 to Schmidt et al., a process is disclosed for selective upgrading of a catalytically cracked gasoline, comprising hydrogenation of aromatic components and isomerization of paraffins to produce synthetic naphthas and isobutane, which can be further processed to obtain desirable blending components for reformulated gasoline. A similar process for selective upgrading of naphthas is described in U.S. Pat. No. 5,235,120 to Bogdan et al., which comprises hydrogenation of aromatics, followed by selective isoparaffin synthesis, to produce upgraded naphthas and isobutane which can be further processed to obtain suitable components for reformulated gasoline. A more recent disclosure in U.S. Pat. 5,498,810 to Bogdan describes an improved version of a process for selective isoparaffin synthesis from naphtha.

Another disclosure related to the improvement and/or reformulation of gasoline is found in U.S. Statutory Invention Registration No. H1305 to Townsend et al., which describes a method for producing reformulated gasoline from conventional gasolines. The method comprises (a) reducing the concentration of aromatic components; (b) reducing the concentration of olefinic compounds; (c) reducing the concentration of sulfur or sulfur-containing compounds; (d) reducing the 90 percent distillation temperature; and (e) adding an oxygenate, e.g., an ether. The reformulated gasoline produced by this general method is expected to cause a reduction in vehicle exhaust emissions of toxics, carbon monoxide and nitrogen oxides. In U.S. Pat. Nos. 5,653,866 and 5,593,567 to Jessup et al., it is stated that by controlling one or more properties of a gasoline fuel suitable for combustion in automobiles, the undesirable emissions of $NO_x$, CO and unburned hydrocarbons can be reduced. The preferred fuel disclosed therein has a Reid Vapor pressure no greater than 7.5 psi (0.51 atm), essentially zero olefins, and a 50% D-86 Distillation Point greater than about 180° F. (82° C.) but less than 205° F. (96.1° C.).

A low severity continuous reforming process for naphthas that operates at conditions resulting in low coke formation and producing an improved reformulated gasoline is disclosed in U.S. Pat. No. 5,382,350 to Schmidt. The conditions for this reforming process include high space velocity, relatively high temperature, and low hydrogen to hydrocarbon ratios. The lower severity operation and a high hydrogen yield in this reforming process facilitate the removal of benzene from the reformulated gasoline pool, while diminishing the anticipated hydrogen deficit that reforming could cause.

The disclosure of U.S. Pat. No. 5,243,121 to Madon et al. describes a fluid catalytic cracking process using hydrocarbon feeds, for increased formation of isobutene and isopentene in the presence of a Y-type zeolite in an $Al_2O_3$ matrix. As above indicated, the branched olefins produced can be further processed to alkyl t-butyl or alkyl t-pentyl ethers, which are of value as blending components for reformulated gasolines. In U.S. Pat. No. 5,196,626 to Child et al., an isoparaffin/olefin alkylation process and reaction system is disclosed in which the liquid acid catalyst inventory is reduced and temperature control is improved by reacting the isoparaffin/olefin feed mixture with a thin film of liquid acid catalyst supported on a heat exchange surface.

A process for the depolymerization and liquefaction of coal to produce a hydrocarbon oil is disclosed in U.S. Pat. No. 4,728,418 to Shabtai et al. The process utilizes a metal chloride catalyst which is intercalated in finely crushed coal and the coal is partially depolymerized under mild hydrotreating conditions during a first processing step. The product from the first step is then subjected to base-catalyzed depolymerization with an alcoholic solution of an alkali hydroxide in a second processing step, and then is hydroprocessed with a sulfided cobalt molybdenum catalyst in a third processing step to obtain a hydrocarbon oil as the final product.

All of the above patents relate to processes for production of reformulated gasoline compositions, reformulated blending components, or hydrocarbon oils, using petroleum-derived streams or fractions, or coal, as feeds which are nonrenewable sources of energy. Renewable sources such as biomass or its components have been extensively examined as an alternative source for fuels, and in particular oxygenated fuels, e.g., ethanol and various ethers.

For example, U.S. Pat. No. 5,504,259 to Diebold et al. discloses a high temperature (450–550° C.) process for conversion of biomass and refuse derived fuel (RDF) as feeds into ethers, alcohols, or a mixture thereof. The process comprises pyrolysis of the dried feed in a vortex reactor, catalytically cracking the vapors resulting from the pyrolysis, condensing any aromatic byproduct fraction followed by alkylation of any undesirable benzene present in the fraction, catalytically oligomerizing any ethylene and propylene into higher olefins, isomerizing the olefins to branched olefins, and catalytically reacting the branched olefins with an alcohol to form an alkyl t-alkyl ether suitable as a blending component for reformulated gasoline. Alternatively, the branched olefins can be hydrated with water to produce branched alcohols. Although the final alkyl t-alkyl etheric products of the above process are of value as blending components for reformulated gasoline, the anticipated low selectivity of the initial high-temperature pyrolysis stage of the process and the complexity of the subsequent series of treatments of intermediate products may limit the overall usefulness of the process.

A series of treatments of plant biomass resulting in the production of ethanol, lignin, and other products is disclosed in U.S. Pat. No. 5,735,916 to Lucas et al. Sugars are fermented to ethanol using an existing closed-loop fermentation system which employs a genetically engineered thermophilic bacteria. The two desirable products of this process, i.e., lignin and ethanol, are mixed to produce a high energy fuel. In U.S. Pat. No. 5,478,366 to Teo et al., the preparation of a pumpable slurry is disclosed for recovering fuel value from lignin by mixing lignin with water, fuel oil and a dispersing agent, the slurry being defined as a pourable, thixotropic or near Newtonian slurry containing 35–60 wt-% of lignin and suitable for use as a liquid fuel.

A process for chemically converting polyhydric alcohols into a mixture of hydrocarbons and halogen-substituted hydrocarbons is disclosed in U.S. Pat. No. 5,516,960 to Robinson. Also disclosed is a process for conversion of cellulose or hemicellulose to hydrocarbon products of possible value as fuels. U.S. Pat. No. 4,647,704 to Engel et al. describes a hydrocracking process, in the presence of a supported NiW catalyst, for conversion of lignin into a mixture of phenolic compounds.

Although the above described patents indicate that biomass or its components including lignin can be converted into fuel products, there is no disclosure as to selective conversion of lignin into gasoline, and in particular reformulated hydrocarbon gasoline. Accordingly, a selective process for high-yield conversion of biomass or important biomass components such as lignin into reformulated gasoline and reformulated gasoline blending components is highly desirable.

SUMMARY AND OBJECTS OF THE INVENTION

It is a primary object of the present invention to provide a process for producing reformulated gasoline compositions having high fuel efficiencies and clean, non-polluting combustion properties.

It is another object of the present invention to provide a process for producing superior quality reformulated gasoline compositions which are reliable and cost-efficient.

It is a further object of the present invention to provide a method for producing such superior quality reformulated gasoline compositions from a feed source that is a renewable, abundant, and inexpensive material such as biomass or its components.

To achieve the foregoing objects, and in accordance with the invention as embodied and broadly described herein, the present invention is directed to a novel two-stage process for conversion of inexpensive and abundant lignin feed materials to high-quality reformulated gasoline compositions in high yields. The process of the invention is a catalytic reaction process that produces a reformulated hydrocarbon gasoline product with a permissible aromatic content, i.e., about 25 wt-% or less, or with no aromatics.

In the first stage of the process, a lignin material is subjected to a base-catalyzed depolymerization ("BCD") reaction in the presence of a supercritical alcohol as a reaction medium, to thereby produce a depolymerized lignin product. The lignin product includes a mixture of mono-cluster compounds, i.e., mono-, di-, and polyalkylsubstituted phenols and benzenes, accompanied by variable amounts of alkoxyphenols, alkoxybenzenes, and some dimeric and trimeric compounds. The relative yields of the depolymerized lignin components can be conveniently controlled by selecting a suitable BCD processing temperature and reaction time to produce depolymerized lignins having various oxygen-content levels.

In the second stage, the depolymerized lignin product is subjected to a sequential two-step hydroprocessing reaction to produce a reformulated hydrocarbon gasoline product. In the first hydroprocessing treatment step, the depolymerized lignin is contacted with a hydrodeoxygenation catalyst to produce a hydrodeoxygenated intermediate product. In the second hydroprocessing treatment step, the hydrodeoxygenated intermediate product is contacted with a hydrocracking/ring hydrogenation catalyst to produce the reformulated hydrocarbon gasoline product which includes a mixture of desirable polyalkylated naphthenes, multibranched paraffins, and $C_7$–$C_{11}$ alkylbenzenes. These and other features, objects and advantages of the present invention will become more fully apparent from the following description and appended claims, or may be learned by the practice of the invention as set forth hereinafter.

BRIEF DESCRIPTION OF THE DRAWINGS

In order to more fully understand the manner in which the above-recited and other advantages and objects of the invention are obtained, a more particular description of the invention briefly described above will be rendered by reference to a specific embodiment thereof illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE INVENTION

Figure 1:
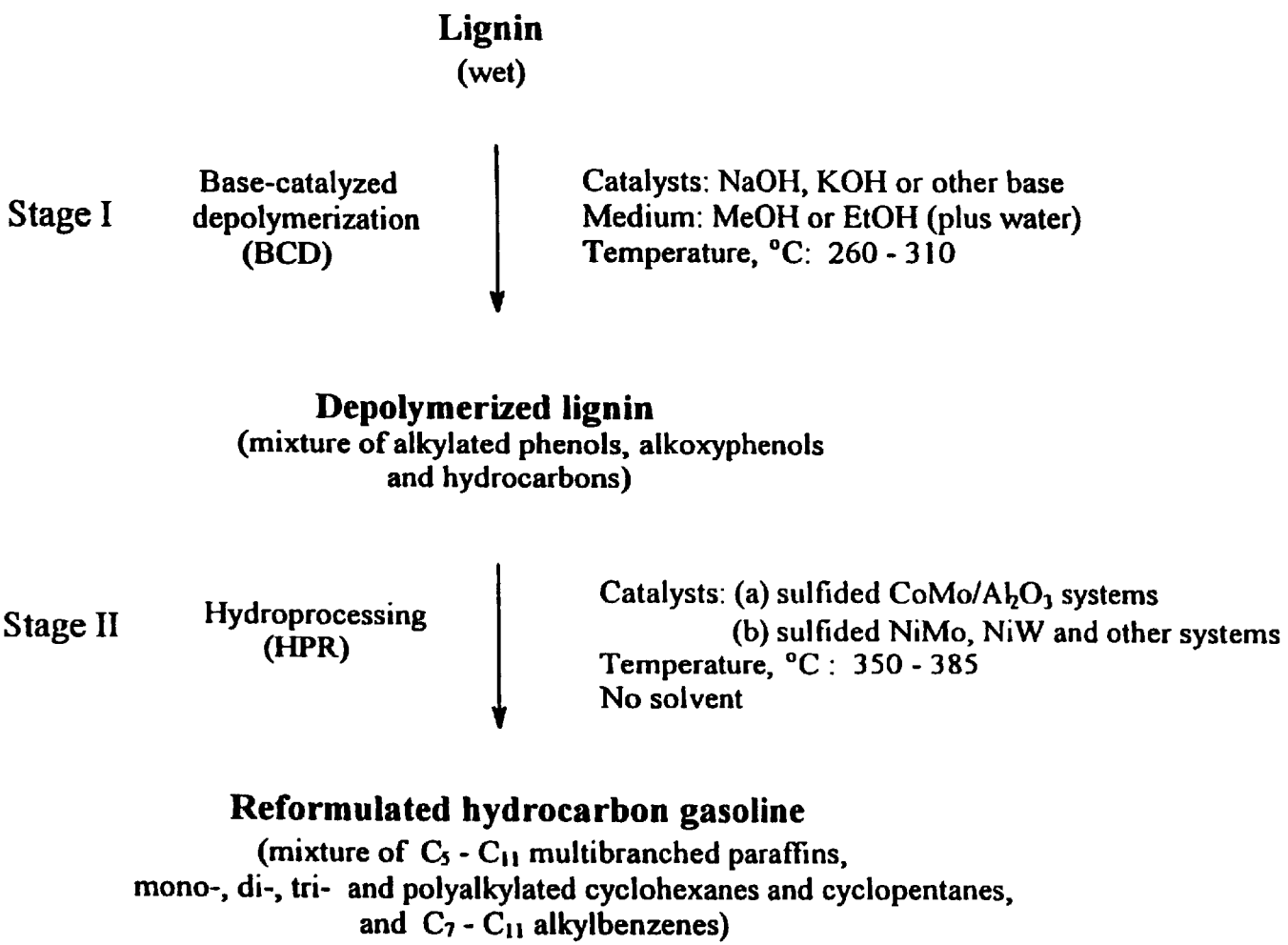
FIG. 1 is a schematic process flow diagram of a two-stage process for converting lignin to a reformulated hydrocarbon gasoline according to the present invention.

The present invention is directed to a novel two-stage process for conversion of inexpensive and abundant biomass such as lignin feed materials to high-quality reformulated gasoline compositions in high yields. The process of the invention is a catalytic two-stage reaction process for production of a reformulated hydrocarbon gasoline product with a controlled amount of aromatics.

In the first stage of the process, as discussed in further detail below, a lignin material is subjected to a base-catalyzed depolymerization reaction in the presence of a supercritical alcohol as a reaction medium, to thereby produce a depolymerized lignin product. In the second stage of the process, the depolymerized lignin product is subjected to a sequential two-step hydroprocessing reaction to produce a reformulated hydrocarbon gasoline product. In the first hydroprocessing reaction step, the depolymerized lignin is contacted with a hydrodeoxygenation catalyst to produce a hydrodeoxygenated intermediate product. In the second hydroprocessing reaction step, the hydrodeoxygenated intermediate product is contacted with a hydrocracking/ring hydrogenation catalyst to produce the reformulated hydrocarbon gasoline product which includes various structurally desirable naphthenic and paraffinic compounds.

The process of the invention provides the basis for a technology aimed at production of a reformulated hydrocarbon gasoline composed of a main component including an appropriately balanced mixture of highly efficient and desirable saturated hydrocarbons (e.g., at least about 75 wt-%), and a secondary component of a well controlled and permissible concentration of aromatics (e.g., up to about 25 wt-%).

Another important consideration in the development of the process of this invention is the nature of the feed. Whereas petroleum is expected to continue to play a predominant role in providing gasoline-range products in the near future, some alternative sources, in particular renewable biomass, are expected to play a gradually increasing role as feeds for liquid fuels. Biomass, which is a continuously renewable, abundant, and inexpensive feed source, and, on the other hand, a reliable and cost-effective production process, are both needed to ensure that biomass-based reformulated gasoline compositions can be produced and supplied in large quantities and at competitive prices.

A preferred biomass for use as the feed source in the process of the invention is lignin. Lignin is the most abundant natural aromatic organic polymer and is found extensively in all vascular plants. Thus, lignin is a major component of biomass, providing an abundant and renewable energy source. The lignin materials used as feeds for the process of the invention are readily available from a variety of sources such as the paper industry, agricultural products and wastes, municipal wastes, and other sources.

The gasoline reformulation compositions of the present invention can involve several, preferably coordinated chemical modifications, i.e., (1) control of the aromatic hydrocarbons content at a permissible level of up to about 25 wt-% and practical exclusion of benzene as a component of the aromatic hydrocarbons fraction; (2) increase in the proportion of high-octane multibranched paraffins; (3) increase in the proportion of polyalkylated, preferably di-, tri-, and tetrasubstituted naphthenes, e.g., di-, tri-, and tetramethylsubstituted cyclohexanes and cyclopentanes; and (4) addition of oxygenated components, e.g., ethers and/or alcohols, to a level of at least about 2 wt-%.

The main features of the two-stage process of the invention for conversion of lignin into reformulated hydrocarbon gasoline are shown in the schematic process flow diagram of FIG. 1. The process as shown in FIG. 1 will be discussed in further detail as follows.

1. Stage I—Base-Catalyzed Depolymerization

In the first stage of the process of the invention, a lignin material that is preferably wet is supplied from a feed source and is subjected to a low temperature, base-catalyzed depolymerization (BCD) reaction. The BCD reaction uses a catalyst-solvent system of an alkali hydroxide and a supercritical alcohol such as methanol, ethanol, or the like as a reaction medium/solvent. The lignin material can contain water already or can be mixed with water prior to usage in the process of the invention. The water can be present in an amount from about 10 wt-% to about 200 wt-%, and preferably from about 50 wt-% to about 200 wt-% with respect to the weight of the lignin material.

It is an advantage of the invention that the reaction medium may contain water, however, there must be a sufficient amount of alcohol such as methanol or ethanol to maintain the supercritical conditions of the BCD reaction. Such conditions are easily achieved at alcohol/lignin weight ratios in the range of about 10 to about 1. A preferred methanol/lignin weight-ratio is from about 7.5 to about 2, while a preferred ethanol/lignin weight-ratio is from about 5 to about 1. Water can be included in the reaction medium by using an aqueous lignin dispersion as feed, or water can be added during the BCD reaction.

Solutions of a strong base such as sodium hydroxide, potassium hydroxide, cesium hydroxide, calcium hydroxide, and the like are utilized to form the catalyst system employed in the BCD reaction. The NaOH, KOH, CsOH, $Ca(OH)_2$, or other strong bases are combined with methanol or ethanol, or with alcohol-water mixtures, to form effective catalyst/solvent systems for the BCD reaction. The base catalyst is dissolved in methanol or ethanol in a concentration from about 5 wt-% to about 10 wt-%. Solutions of NaOH are preferable depolymerizing catalyst agents, with the NaOH solutions exhibiting very high BCD activity and selectivity. The concentration of NaOH in methanol or ethanol, or in mixtures of these alcohols with water, is usually moderate, preferably in the range of about 5 wt-% to about 7.5 wt-%. It is an important feature of the process of this invention that the unreacted alcohol is recoverable during or after the BCD reaction.

The BCD reaction can be carried out at a temperature in the range from about 250° C. to about 310° C., and preferably from about 270° C. to about 290° C. The depolymerization reaction time can range from about 30 seconds to about 15 minutes.

The lignin feed used in the process of this invention can practically include any type of lignin independently of its source or method of production. Suitable lignin materials include Kraft lignins which are a by-product of the paper industry, organosolve lignins, lignins derived as a byproduct of ethanol production processes, lignins derived from waste including municipal waste, lignins derived from agricultural products or waste, various combinations thereof, and the like.

Under suitable processing conditions, the BCD reaction proceeds with very high feed conversion (e.g., 95 wt-% or greater), yielding a mixture of depolymerized lignin products. Such products include mostly alkylated phenols such as mono-, di-, tri-, and polysubstituted phenols and alkylated benzenes, accompanied by variable amounts of alkylated alkoxyphenols, alkoxybenzenes, and hydrocarbons. The composition of the BCD lignin product, that is the relative yields of the depolymerized compounds, can be conveniently controlled by the BCD processing conditions, in particular by the reaction temperature, the reaction time, the alcohol/lignin weight ratio, the type of alcohol, the water/alcohol weight ratio, and the level of the autogenous pressure developed during the BCD process. The following description provides further details of preferred BCD processing conditions and their effect upon the composition of BCD products.

(a) Reaction Temperature

In the lower temperature range of about 230–250° C. using methanol as the reaction medium, the BCD lignin product includes primarily methoxy-substituted alkylphenols with —$OCH_3$ groups at the C-2 and C-6 positions, and with $CH_3$, $C_2H_5$, and $C_3H_7$ (or $C_3H_5$) groups mostly at the C-4 position. This corresponds to the anticipated structure of depolymerized monomeric units derived from lignin with indicated very low extent of ring alkylation by the methanol medium.

An increase in temperature to about 270–290° C. causes a major change in the composition of the BCD lignin-derived products, with the products comprising mostly mono-, di-, tri-, and polymethylated phenols and corresponding mono-, di-, tri- and polymethylated benzenes, plus some branched paraffins. This composition clearly shows a major extent of replacement of methoxy with $CH_3$ groups in the BCD lignin-derived product components with an increase in temperature from the 230–250° C. range to the 270–290° C. range. This is due to either direct ring alkylation by the methanol medium or deoxygenative rearrangement of the —$OCH_3$ substituents. An optimum total number of one to three $CH_3$ substituents per molecule in the BCD lignin-derived product components is easily achieved at a temperature of about 270–290° C. by proper selection of a short reaction time and a low alcohol/lignin weight ratio. Thus, the temperature range of about 270–290° C. is a preferred processing temperature range for the BCD reaction of Stage I.

(b) Reaction Time

The BCD reaction is characterized by a very high lignin conversion rate which greatly facilitates its high-yield performance in a continuous flow reactor. The preferred range of residence times in the reactor at 270° C. is from about 1 minute to about 5 minutes, and at 290° C. is from about 30 seconds to about 2.5 minutes. At such short reaction times, and particularly for low methanol/lignin or ethanol/lignin ratios, and with about 10–15 wt-% of water in the feed, the consumption of alcohol by ring alkylation of the depolymerized products can be easily controlled. If desired, alcohol consumption can be limited to amounts of about 5–20 g of methanol per 100 g of lignin, or about 10–28 g of ethanol per 100 g of lignin, with the amounts corresponding to the incorporation of between 0.2 to 1 mole of alcohol per product molecule. Higher incorporation of the alcohol if desired is easily achieved by increasing the reaction time and/or the alcohol/lignin feed weight ratio.

(c) Alcohol/Lignin Weight Ratios

A particularly preferred range for the methanol/lignin or ethanol/lignin weight ratio in the feed solution is from about 3:1 to about 5:1. With this range of weight ratios and by proper adjustments in the reaction time, the total number of methyl or ethyl substituents in the depolymerized product components can be easily regulated not to exceed 1 to 3 alkyl groups per depolymerized molecule. These 1 to 3 alkyl groups include alkyl groups present in the structure of the monomeric lignin units and alkyl groups, such as methyl or ethyl groups, inserted in the lignin units during the BCD reaction.

(d) Type of Alco

In general, the reactivity of ethanol for ring alkylation of depolymerized phenolic products, during the BCD reaction of lignin, is markedly higher than that of methanol. To minimize the incorporation of ethyl groups in the BCD lignin product, the shortest possible reaction times, such as about 30 seconds to about 2 minutes, and low ethanol/lignin weight ratios of about 3:1 or less are strongly preferred.

(e) Reaction Pressure

The methanol or ethanol solvent/medium is under supercritical conditions above 250° C. Thus, the BCD reaction in the preferred temperature range of 270–290° C. proceeds under significant autogenous pressure. The pressure during the BCD reaction is in a range from about 1600–2500 psig in autoclave reactors, and less than about 2,000 psig in a continuous flow reactor system. The methanol or ethanol solvent/medium under supercritical conditions is a supercritical fluid exhibiting properties between those of a liquid and a gas phase.

The first stage of the process of the invention provides many benefits and advantages. The BCD reaction comprises a versatile depolymerization-liquefaction reaction resulting in the high-yield production of oxygenated precursors of the final reformulated hydrocarbon gasoline product, that is obtained by hydroprocessing of the precursors from the BCD reaction in the subsequent second stage discussed below. It is an important advantage that the BCD reaction proceeds with a major (~50%) decrease in oxygen content, relative to that of the lignin feed, with the decrease being from about 27–28 wt-% in the lignin feed to about 8–16 wt-%, preferably about 12–14 wt-%, in the depolymerized lignin product.

Another advantage of the BCD reaction is that it allows, to an important extent, for control over the composition of the final reformulated hydrocarbon gasoline. Since the degree and type of ring substitution in the monomeric lignin products can be controlled by the BCD processing conditions, and since the subsequent hydroprocessing second stage of the process proceeds without major skeletal rearrangements in the monomeric lignin products, the composition of the final reformulated gasoline is predetermined to a significant extent already during the BCD first stage of the process.

2. Stage II—Hydroprocessing

In the second stage of the process of the invention, the depolymerized lignin product from the first stage is subjected to a hydroprocessing reaction that includes two sequential hydroprocessing (HPR) treatments, which can be performed as a single operation in a series flow reactor without a solvent. In the first HPR treatment, the depolymerized lignin feed is subjected to exhaustive hydrodeoxygenation (HDO) which yields hydrodeoxygenated products. In the immediately following second HPR treatment, the hydrodeoxygenated lignin product from the HDO treatment is subjected to partial ring hydrogenation and mild hydrocracking (HCR) to produce the final reformulated hydrocarbon gasoline (RHG) product. The first and second HPR treatments are carried out in a temperature range from about 350° C. to about 390° C. The final RHG product includes a well-balanced mixture of the following three types of hydrocarbons: (a) mono-, di-, tri-, and some tetralkylsubstituted cyclohexanes and cyclopentanes; (b) mono-, di-, tri-, and some tetraalkylsubstituted benzenes; and (c) $C_5$–$C_{11}$, multibranched paraffins.

The exhaustive HDO step in the first HPR treatment of the second stage of the process is performed using a hydrodeoxygenation catalyst such as a sulfided $CoMo/Al_2O_3$ catalyst system. The exhaustive HDO step is carried out at a preferred temperature range of about 350–375° C. and under a preferred hydrogen pressure in the range of about 1400–2200 psig. A preferred $CoMo/Al_2O_3$ catalyst includes about 2.5 wt-% to about 6 wt-% of cobalt and about 7 wt-% to about 10 wt-% of molybdenum.

For a BCD feed obtained in the presence of methanol as reaction medium, the light hydrodeoxygenated oil product obtained by the HDO step under the preferred processing conditions primarily includes a mixture of toluene, ethylbenzene, xylenes, trimethylbenzenes, $C_3$-alkylbenzenes, ethylmethylbenzenes and some $C_4$-alkylbenzenes ($C_4$-alkyl indicating the total number of carbons in 1 to 4 alkyl substituents). Prominently absent in the HDO product mixture is benzene, which is an undesirable carcinogenic compound, usually present in aromatic hydrocarbon fractions. For example, a practically benzene-free mixture of $C_7$–$C_{10}$ alkylbenzenes is present in the HDO product. While trace amounts of benzene can be present in the HDO product (e.g., less than about 0.2 wt-%), the substantial absence of benzene is due to the absence of nonsubstituted aromatic rings in the lignin structural network.

The supplemental mild hydrocracking (HCR) and partial ring hydrogenation treatments of the intermediate HDO product in the second HPR treatment is performed in the presence of a hydrocracking/ring hydrogenation catalyst which is preferably a sulfided metal-promoted catalyst system. Such a sulfided catalyst system has a formula of $MMo/SiO_2$-$Al_2O_3$ or $MW/SiO_2$-$Al_2O_3$, where M=metals such as Co, Ni, Ru, Ir, Pt, Fe, Rh, Pd, Cr, or Re. Examples of suitable sulfided catalyst systems include $NiW/SiO_2$-$Al_2O_3$, $NiMo/SiO_2$-$Al_2O_3$, $CoMo/SiO_2$-$Al_2O_3$, $FeMo/SiO_2$-$Al_2O_3$, combinations thereof, and the like. Other suitable catalyst systems are disclosed in the following two articles, the entire disclosures of which are incorporated herein by reference: Shabtai, J. et al., *Catalytic Functionalities of Supported Sulfides, IV C-O Hydrogenolysis Selectivity as a Function of Promoter Type*, J. Catal. 104: 413–423 (1987); and Shabtai, J. et al., *Catalytic Functionalities of Supported Sulfides, V C-N Hydrogenolysis Selectivity as a Function of Promoter Type*, J. Catal. 113: 206–219 (1988). Corresponding MMo and MW catalyst systems, supported on $TiO_2$-$Al_2O_3$ are also effective for the HCR treatment step.

The processing conditions for the HCR treatment step of the intermediate HDO product include a temperature in the range of about 350–390° C., preferably about 385–390° C., and a hydrogen pressure in the range of about 1900–2800 psig, preferably about 2200–2800 psig. The preferred processing condition ranges result in significant conversion (e.g., about 30 wt-% or greater) of aromatic and naphthenic components in the intermediate HDO product into multibranched paraffins.

By proper selection of a catalyst of moderate ring hydrogenation activity and relatively short reaction time (see Examples below), the extent of ring hydrogenation can be controlled to obtain a final RHG product containing the permissible concentration of total aromatic hydrocarbons of about 25 wt-% or less, and a substantially zero concentration of benzene which is absent in the intermediate HDO product. For example, the second HPR treatment (HCR) can be moderated and controlled by reducing the hydrogen pressure and reaction time to produce a partially hydrogenated reformulated gasoline product containing a concentration of about 25 wt-% or less of alkylbenzenes. Furthermore, if an increase in multibranched paraffinic components is desired, the HCR reaction can be controlled to cause increased hydrocracking of alkylated naphthenic products into such multibranched paraffinic components.

If desired, an oxygenated additive can be mixed with the final RHG product in amounts of about 2 wt-% or greater, in order to augment the efficiency and improve the combustion properties of the final RHG product. Examples of suitable oxygenated additives include ethanol, alkyl t-alkyl ethers such as methyl tertiary butyl ether (MTBE), ethyl t-butyl ether, and methyl t-pentyl ether, and the like, which may be used singly or in a variety of mixtures.

The second stage of the process of the invention provides many benefits and advantages. The primary objective of the second stage of the process of the invention is to convert the BCD product, obtained in Stage I of the process, into a high quality reformulated hydrocarbon gasoline product. The second stage includes a versatile hydroprocessing reaction sequence, resulting in a superior quality final gasoline product from lignin. In the initial HDO treatment, the BCD feed is converted into a light, $C_7$–$C_{11}$, aromatic hydrocarbon liquid product. This product has the important advantage, as compared with petroleum-derived aromatic hydrocarbon fractions, of being benzene-free such that there is substantially no benzene present in the product.

Another important advantage of the HPR treatment in Stage II of the process of the invention is that the HDO treatment producing a desirable benzene-free mixture of gasoline-range $C_7$–$C_{11}$ alkylbenzenes, can be directed to independently produce a benzene-free mixture of $C_7$–$C_{11}$ alkylbenzenes for use as blending components in petroleum-derived reformulated gasolines.

The objectives of the subsequent mild hydrocracking treatment of the aromatic HDO product are: (a) to convert any residual oligomeric components in the HDO product into fully depolymerized monomeric components; and (b) to partially hydrogenate the HDO product for the purpose of producing a well balanced final reformulated hydrocarbon gasoline product, including $C_5$–$C_{11}$ multibranched paraffins, $C_7$–$C_{11}$ aromatic hydrocarbons in a permissible concentration of about 25 wt-% or less, and di-, tri-, and tetraalkylated cyclohexanes and cyclopentanes.

The reformulated gasoline compositions produced according to the present invention demonstrate greatly superior properties when compared to current commercial gasoline compositions. In particular, the reformulated gasoline compositions of the invention exhibit desirable high fuel efficiencies, as well as clean-burning and non-polluting combustion properties. The reformulated gasoline compositions are also reliable and cost-efficient. Further, the process of the invention produces superior quality reformulated gasoline compositions from a biomass feed source that is renewable, abundant and inexpensive.

EXAMPLES

The experimental procedures applied as well as the yield and composition of products obtained under preferred processing conditions of the invention are illustrated by the following non-limiting examples.

Example 1

A 15.0 g sample of a Kraft lignin (Indulin AT) was pretreated by washing with an aqueous KOH solution and water. The elemental composition of the lignin sample was as follows (wt-%): C, 66.30; H, 5.98; N, 0.10; S, 1.25; and O, 26.37. The lignin sample was introduced in a 300 cc autoclave (Autoclave Engineers) and 120 g of a 7.5 wt-% NaOH solution in methanol was added (methanol/lignin weight ratio=7.4:1). The autoclave was purged with nitrogen and the mixture was brought, with constant stirring (100 rpm), to a temperature of 290° C., left to react at that temperature for 10 minutes with faster stirring (500 rpm), and then quickly cooled down to room temperature. The liquid/semi-solid product mixture was removed from the autoclave, 100 cc of water was added to the mixture, and the mixture was acidified to a pH of about 2.0, with constant stirring, using an aqueous 2N HCl solution. The mixture was kept overnight and the accumulated organic liquid/semi-solid phase was separated from the water-methanol layer by decantation, washed with some water, dried under a stream of nitrogen, and subjected to Soxhlet extraction with ether. The extract was dried with anhydrous $MgSO_4$, filtered, and then freed from the ether on a Rotavapor to obtain the final BCD product. The water-methanol layer was worked up to recover by liquid/liquid extraction a small portion of organic liquid/semi-solid material which was added to the main BCD product. The conversion of the lignin feed was 94.6 wt-% as determined by the weight of unreacted solid residue. The distribution of the total BCD product (17.5 g) was as follows (wt-%; calculated on converted lignin): liquid/semi-solid depolymerized compounds, 98.5; gaseous products (mainly $C_1$–$C_4$ gases and $CO_2$), 1.5.

Figure 2:
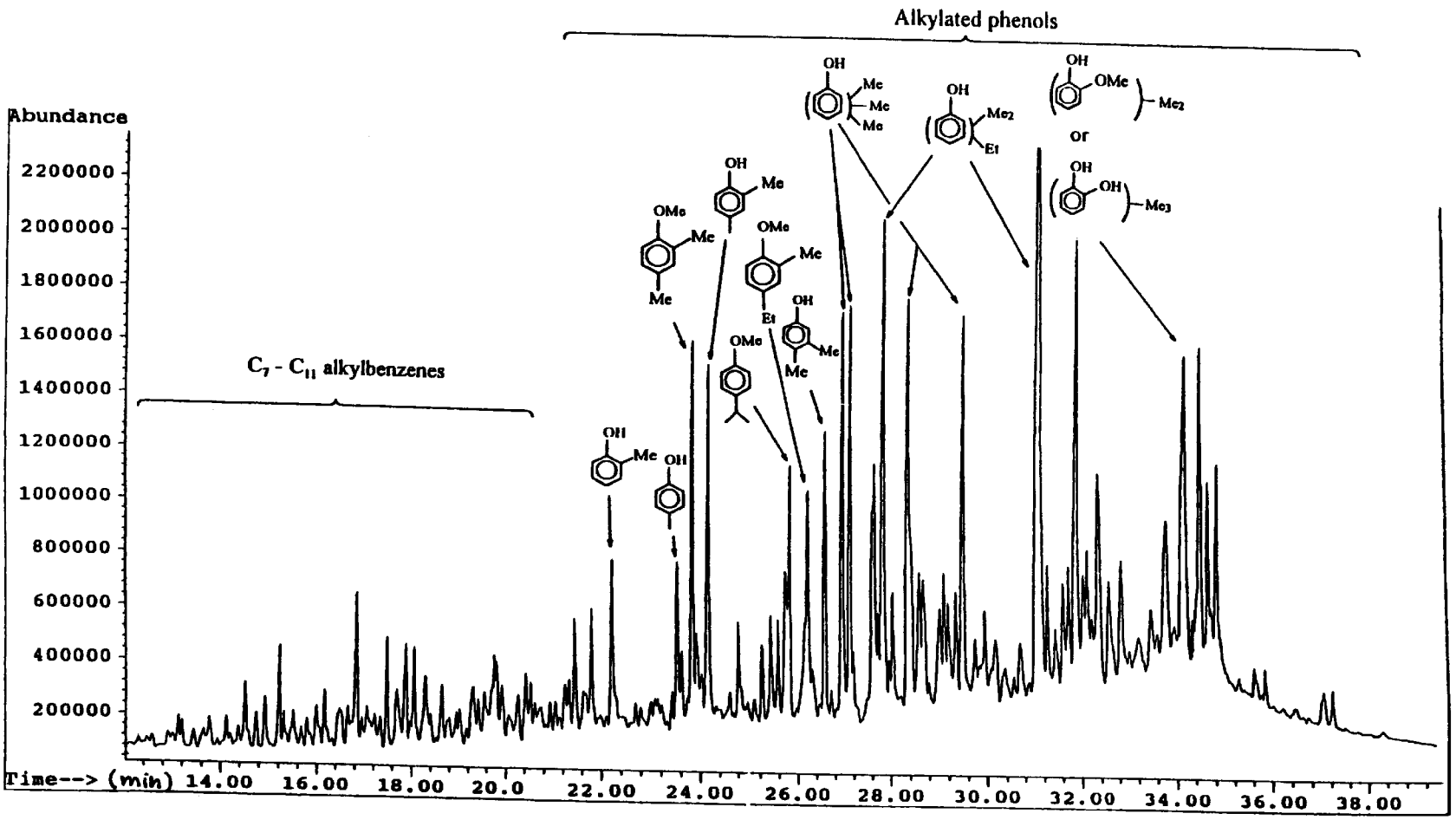
FIG. 2 is a graph showing the chemical composition of the product obtained by the base-catalyzed depolymerization reaction in the first stage of the process according to the present invention.

FIG. 2 is a graph of the gas chromatographic/mass spectral (GC/MS) analysis of the liquid/semi-solid BCD product, showing that the product is mainly composed of mono-, di-, and trialkylsubstituted phenols and methoxyphenols, accompanied by smaller amounts of $C_7$–$C_{11}$ alkylbenzenes and branched paraffins (alkyl designates mostly methyl and some ethyl or isopropyl substituents). The elemental composition of the BCD product was as follows (wt-%): C, 78.46; H, 8.54; N, 0.08; S, 0.05; and O, 12.87. This elemental composition showed that the BCD reaction proceeded with a decrease of about 50 wt-% in oxygen content and with essentially complete sulfur elimination.

In a subsequent hydroprocessing (HPR) stage, the BCD product was subjected to exhaustive hydrodeoxygenation (HDO), immediately followed by mild hydrocracking/partial ring hydrogenation, as follows.

10.0 g of the BCD product and 2.0 g of a $3Co8Mo/Al_2O_3$ (Akzo Nobel) catalyst were introduced into a 50 cc Microclave reactor (Autoclave Engineers), and the Microclave reactor was sequentially purged with nitrogen and hydrogen, and then pressurized with hydrogen. The reactor was heated to 360° C. with constant stirring (100 rpm) and then kept at this temperature under a hydrogen pressure of about 1800 psig for 2 hours with increased stirring (500 rpm). At the end of the run the reactor was quickly cooled down to room temperature and the hydrodeoxygenated oil product was separated from the catalyst and water (formed in some amounts during the HDO reaction) by centrifugation.

Figure 3:
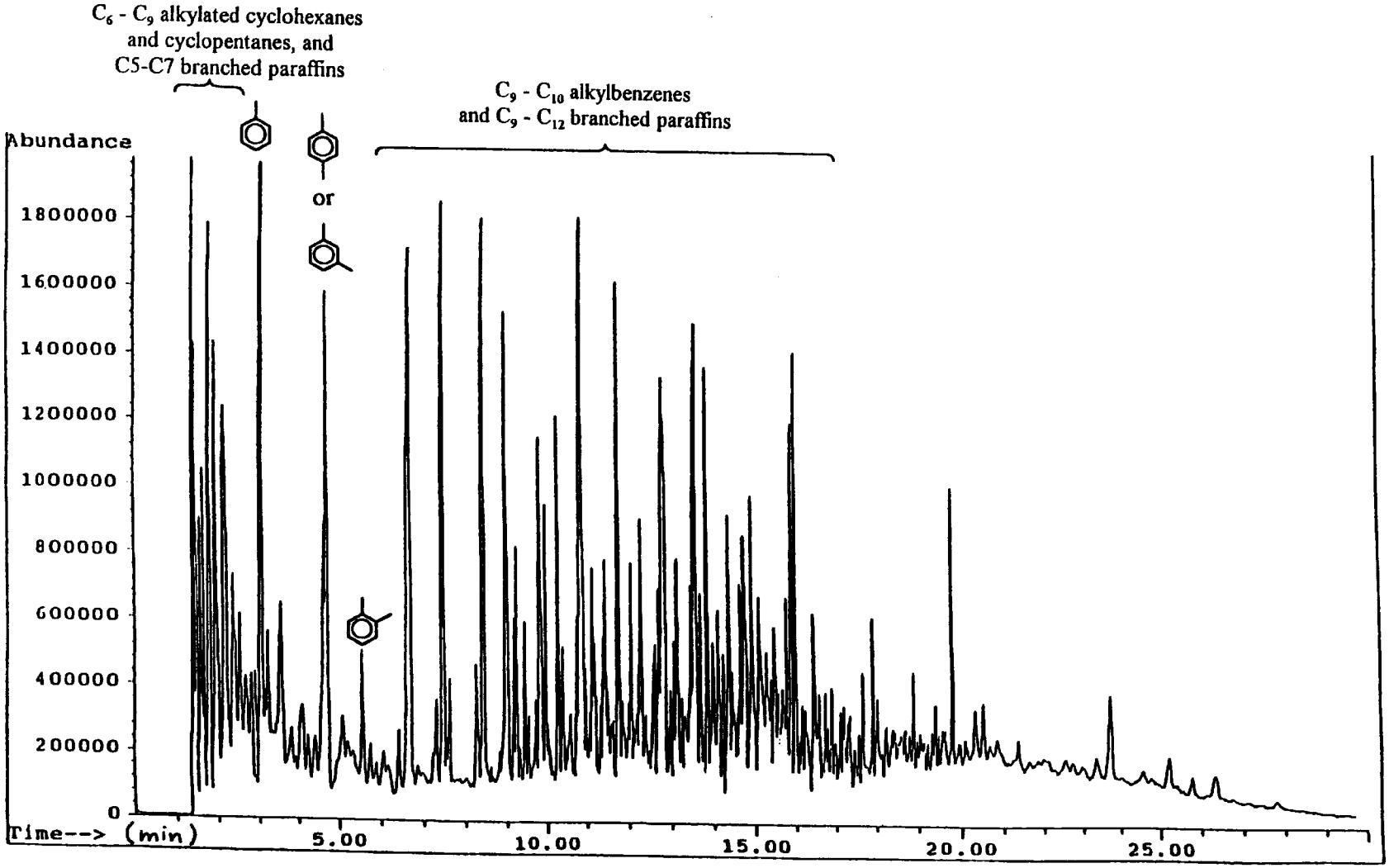
FIG. 3 is a graph showing the chemical composition of the product obtained by the catalytic hydrodeoxygenative reaction in the second stage of the process according to the present invention.

FIG. 3 is a graph of the GC/MS analysis of the hydrodeoxygenated oil product, showing that the product is composed mainly of mono-, di-, and trialkylbenzenes (alkyl designating mostly methyl and some ethyl or isopropyl substituents), accompanied by smaller amounts of $C_5$–$C_{12}$ branched paraffins and some higher ($C_{10}$) alkylated benzenes. The total yield of this HDO product after drying was 7.4 g, corresponding to about 93% of the theoretically possible.

To eliminate any small amounts of residual dimeric compounds and to partially hydrogenate the predominant alkylbenzene components of the HDO product, 15.0 g of the HDO product, accumulated from two runs, was subjected to mild hydrocracking/ring hydrogenation in a 50 cc Microclave reactor, equipped with a device for product sampling during the reaction. 3.0 g of a 3.6Ni21W/$SiO_2$-$Al_2O_3$ catalyst (Engelhard) was added to the feed, and the Microclave reactor was pressurized with hydrogen and heated up to 375° C. The reaction was allowed to proceed at this temperature and a 2400 psig working hydrogen pressure, and product samples were withdrawn every 15 min for GC/MS analysis and calibrated simulated distillation. The extent of ring hydrogenation of alkylbenzenes (in the HDO-derived feed) to corresponding alkylcyclohexanes and cyclopentanes was about 35% after 10 minutes, and nearly 60% after 20 minutes of reaction time. Complete hydrogenation was observed after 2 hours of reaction time.

Figure 4:
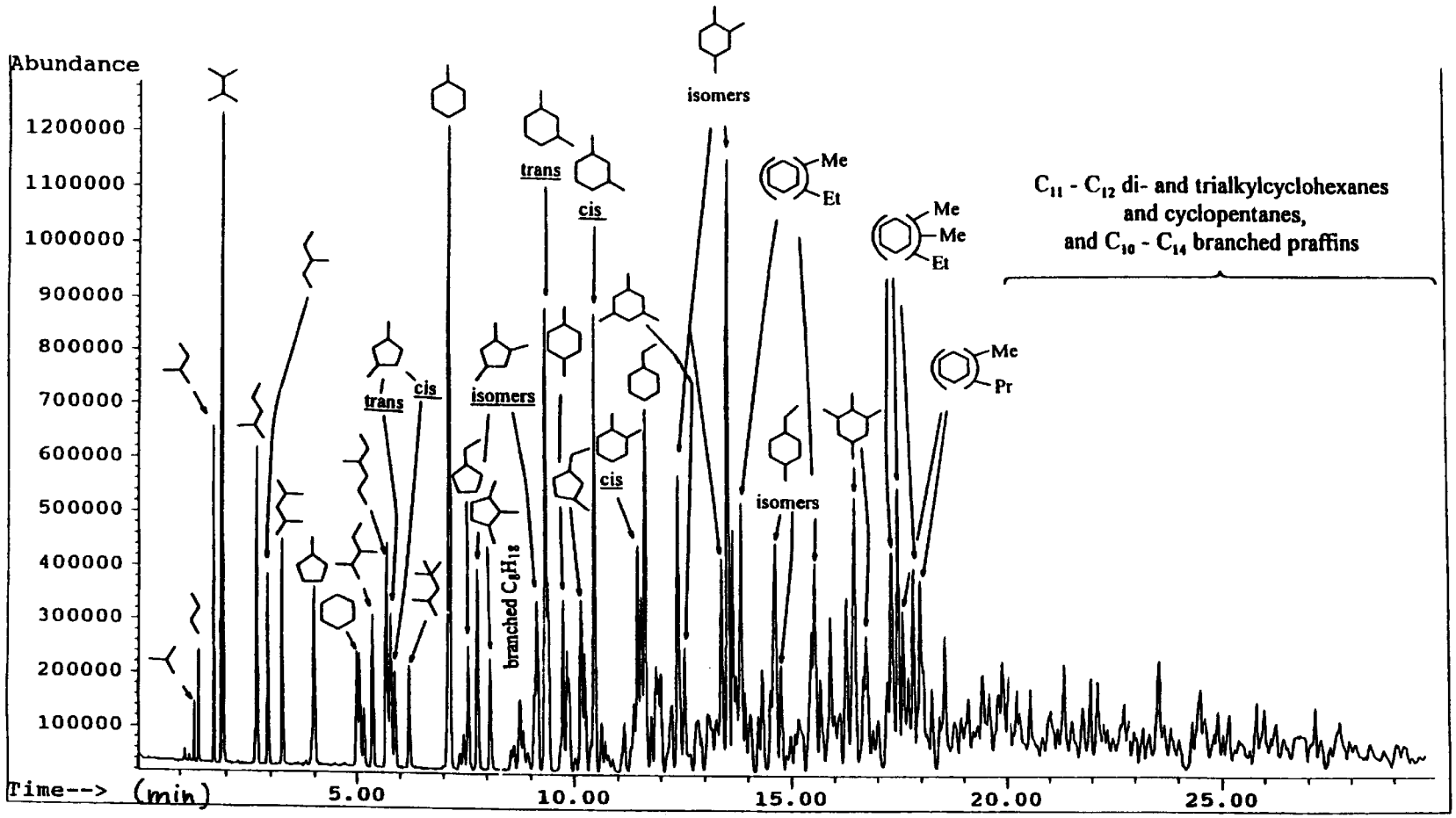
FIG. 4 is a graph showing the chemical composition of the saturated hydrocarbon gasoline product components obtained by the process according to the present invention.

FIG. 4 is a graph of the GC/MS analysis of the final fully hydrogenated HPR product, showing that the product is composed mainly of mono-, di-, and trialkylcyclohexanes and cyclopentanes, and smaller amounts of branched paraffins. The yield of the final HPR product (14.8 g), based on the starting aromatic (HDO-derived) feed was 98.7 wt-%. This corresponds to a final reformulated gasoline yield of 73.3 wt-% based on the starting lignin feed. Any residual dimeric components of the intermediate HDO product were fully hydrocracked to monocyclic compounds within 20 minutes of reaction time in the second HPR step. The described procedure of mild hydrocracking/partial ring hydrogenation of the BCD product allows for effective control over the composition of the final reformulated gasoline, with alkylbenzene concentrations in the reformulated gasoline easily adjusted to the permissible level of up to about 25 wt-%.

Example 2

In a comparative run, exactly the same sequential BCD-HPR procedure and identical processing conditions as in Example 1 were applied, except that a different type of lignin was used as feed. A 15.0 g sample of an organosolve lignin provided by Repap Technologies, Inc., and designated as Alcell lignin was utilized. The elemental analysis of the lignin sample was as follows (wt-%): C, 66.20; H, 6.18; N, 0.18; S, 0.022; and O, 27.42. The lignin sample was subjected to a BCD reaction, using 120 g of a 7.5 wt-% NaOH solution as depolymerizing agent and applying the same procedure as in Example 1. The conversion of the lignin feed was 98.4 wt-% as determined by the weight of unreacted solid residue. The distribution of the total BCD product (19.0 g) was as follows (wt-%; calculated on converted lignin): liquid/semi-solid depolymerized products, 94.7; gaseous products, 5.3. The elemental analysis of the BCD liquid/semi-solid product was as follows (wt-%): C, 77.47; H, 8.43; N, 0.10; S, 0.014; O, 13.99. This BCD product was subjected to HPR as in Example 1, and the yield of final reformulated gasoline product was 10.9 g, corresponding to a yield of 72.7 wt-% based on the starting lignin. The results obtained with the Alcell (Repap) lignin are closely similar to those found for the Kraft lignin as feed, indicating that the BCD-HPR procedure is equally applicable to lignins obtained by different processes.

Example 3

In another comparative run, the BCD-HPR procedure and processing conditions were the same as in Example 1, except that a lower reaction temperature, 270° C., was used in the BCD step of the reaction sequence. 15.0 g of Kraft lignin (Indulin AT) and 120 g of a 7.5 wt-% NaOH solution in methanol were used for the reaction. The total lignin conversion was 90.4 wt-%, which was slightly lower than that at 290° C. (94.6 wt-% in Example 1) under otherwise identical processing conditions. The GC/MS analysis of the liquid/semi-solid BCD product showed that the extent of ring substitution in the alkylphenolic product components, as reflected by the average number of alkyl (mostly methyl) substitutents per phenolic ring is lower at 270° C. as compared with that at 290° C. In agreement with this finding, the extent of alkyl substitution in the final BCD-HPR gasoline was lower than that observed in Example 1. The yield of the final reformulated gasoline was 10.8 g corresponding to a yield of 72.0 wt-% based on the starting lignin feed. This run, therefore, demonstrated that a lighter reformulated gasoline product can be produced, without substantial loss in overall yield, by decreasing the temperature in the BCD step from 290° to 270° C.

Example 4

A mixture composed of 3.0 g of Kraft (Indulin AT) lignin and 22.5 g of a 7.5 wt-% NaOH solution in methanol was charged to a 50 cc Microclave reactor (Autoclave Engineers). After purging with nitrogen the Microclave reactor was quickly heated up to 270° C. (12 min) and the mixture was allowed to react at that temperature for only 2.5 minutes. At the end of that time period the heater was immediately removed and the reactor quickly cooled down (about 2 min). The conversion of the lignin was 40.1 wt-%, as determined by the weight of ether-insoluble residue. The GC/MS analysis of the ether-soluble BCD product showed that while the composition of alkylphenolic components of the product is qualitatively similar to that in Example 1 as shown in FIG. 2 (reaction time used in Example 1, 10 minutes), there is a noticeable increase in mono- and dialkylphenols and methoxyphenols, and a corresponding decrease in higher alkylated products such as tri- and tetraalkylsubstituted phenols in the short reaction time (2.5 min) run of Example 4. The observed lower extent of ring substitution at the short reaction time used was reflected also in a lower extent of ring substitution in the final gasoline product obtained in the subsequent HPR step of the process, which was performed under conditions otherwise identical with those described in Example 1. The yield of the final reformulated gasoline product was 71.8 wt-% calculated on converted lignin.

The run of Example 4 demonstrates that the BCD reaction of lignins is very fast and can, therefore, be performed at reaction times of 2.5 minutes or less. This is of particular importance for operation of the BCD process in a continuous flow reactor, that easily allows for the use of very short residence times of about 1–3 min or less. Essentially complete lignin conversion can be achieved by recirculation of the BCD product, if necessary.

Example 5

In another comparative run, a mixture composed of 10.0 g of Kraft (Indulin AT) lignin, 30.0 g of methanol and 7.1 g of NaOH, was allowed to react for 5.0 min at 270° C., using otherwise the same BCD procedure applied in Example 1. The specific processing variable examined in the run of Example 5 was that of a much lower methanol/lignin wt-ratio of 3.0, as compared with that of about 7.5 used in Examples 1–3. The lignin conversion was 58.5 wt-%, as determined by the weight of ether-insoluble unreacted feed residue. The GC/MS analysis of the ether-soluble BCD product showed that there is a significant increase in the proportion of mono- and dialkylphenols, and a corresponding decrease in tri- and higher alkylated phenols in the BCD product (methanol/lignin weight ratio=3.0) in comparison with that obtained in runs with higher methanol/lignin weight ratios, such as 7.5 (see Example 3) or 10.0. A lower extent of ring substitution was found also in the final reformulated gasoline. The yield of the gasoline was 70.9 wt-% calculated on converted lignin.

The run of Example 5 demonstrates that the BCD process can be effectively implemented using low methanol/lignin ratios such as about 3.0, with the added benefit of producing a lighter, less alkylsubstituted gasoline product.

Example 6

A mixture composed of 10.0 g of Kraft (Indulin AT) lignin, 85.0 g of methanol, 10.0 g of water, and 7.1 g of NaOH, was charged to a 300 cc autoclave, and subjected to BCD at 270° C. for 5.0 minutes, using the same procedure as applied in Examples 1 and 3. The autogenous pressure during the run was 1650 psig, the lignin conversion was 74.9 wt-%, and the composition of the BCD product, as examined by GC/MS, was closely similar to that obtained in a parallel run in the absence of water, under otherwise identical processing conditions, with the parallel run resulting in essentially complete lignin conversion. This comparison demonstrated that addition of significant amounts of water to the lignin feed (water/lignin wt-% ratio of at least 1.0) produces no significant changes in the composition of the BCD product, although the lignin conversion was found to be slightly lower. The significance of this result is that lignin feeds containing 100 wt-% or more of water with respect to the weight of the lignin can be directly used in the BCD process without drying.

Example 7

A mixture composed of 15.0 g of Kraft (Indulin AT) lignin and 120 g of a 7.5 wt-% NaOH solution in ethanol was subjected to BCD reaction for 10.0 min at 270° C. The processing conditions were identical with those used in Example 3, except that ethanol was used instead of methanol as the reaction medium. The lignin conversion under the processing conditions was 92.6 wt-%. The GC/MS analysis of the BCD product showed that the product mainly included alkylated phenols and alkoxyphenols, accompanied by smaller amounts of alkylbenzenes and branched paraffins. A specific structural feature of the product was that its alkylated phenolic and alkylated benzene components contained a higher proportion of ethyl substituents as compared with that of methyl substituents produced in the presence of methanol as reaction medium (Examples 1 and 3).

The significance of the run of Example 7 is that ethanol can be effectively used as a BCD reaction medium. It is essential that ethanol be used under proper BCD processing conditions, with the conditions comprising short reaction times (≦5 min) and low ethanol/lignin ratios, such as 3.0, in order to minimize the extent of ring ethylation during the BCD reaction. Introduction of more than one ethyl group per phenolic molecule results in an undesirable increase in molecular weight and a related increase in the boiling point range of the final gasoline (BCD-HPR) product.

Example 8

A mixture composed of 15.0 g of organosolve (Alcell) lignin and 150 g of a 10 wt-% solution of KOH in methanol was subjected to BCD reaction for 10 minutes at 290° C., using the same procedure as in Examples 1 and 2. The lignin conversion and the BCD product composition were closely similar with those obtained with the same type of lignin feed in the presence of NaOH (Example 2), indicating that KOH is an equally efficient base catalyst for the BCD reaction. The use of NaOH as a preferred BCD catalyst is based on its lower molecular weight (higher $OH^{\ominus}$ concentration per gram) and a markedly lower price as compared with KOH.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by united states letters patent is:

1. A process for converting lignin into reformulated hydrocarbon gasoline, comprising the steps of:

(a) providing a lignin material;

(b) subjecting the lignin material to a base-catalyzed depolymerization reaction in the presence of a supercritical alcohol as a reaction medium, to thereby produce a depolymerized lignin product; and (c) subjecting the depolymerized lignin product to a hydroprocessing reaction to produce a reformulated hydrocarbon gasoline product.

2. The process of claim 1, wherein the lignin material is selected from the group consisting of a Kraft lignin, an organosolve lignin, a lignin derived from agricultural products or waste, a lignin derived from municipal waste, and combinations thereof.

3. The process of claim 1, wherein the lignin material contains water or is mixed with water in an amount from about 10 wt-% to about 200 wt-% with respect to the weight of the lignin material.

4. The process of claim 1, wherein the alcohol is selected from the group consisting of methanol, ethanol, and mixtures thereof.

5. The process of claim 4, wherein the depolymerization reaction utilizes a base catalyst selected from the group consisting of sodium hydroxide, potassium hydroxide, calcium hydroxide, cesium hydroxide, and mixtures thereof.

6. The process of claim 5, wherein the base catalyst is dissolved in methanol or ethanol in a concentration from about 5 wt-% to about 10 wt-%.

7. The process of claim 1, wherein the depolymerization reaction is carried out in a temperature range from about 250° C. to about 310° C.

8. The process of claim 1, wherein the depolymerization reaction time is from about 30 seconds to about 15 minutes.

9. The process of claim 4, wherein the methanol/lignin weight-ratio during the depolymerization reaction is from about 2 to about 7.5.

10. The process of claim 4, wherein the ethanol/lignin weight-ratio during the depolymerization reaction is from about 1 to about 5.

11. The process of claim 1, wherein the depolymerized lignin product comprises compounds belonging to the group consisting of alkylated phenols, alkylated alkoxyphenols, hydrocarbons, and mixtures thereof.

12. The process of claim 1, wherein the hydroprocessing reaction includes consecutive first and second hydroprocessing treatment steps in a temperature range from about 350° C. to about 390° C.

13. The process of claim 12, wherein the first hydroprocessing treatment step utilizes a hydrodeoxygenation catalyst comprising a sulfided $CoMo/Al_2O_3$ system.

14. The process of claim 13, wherein the hydrodeoxygenation catalyst includes about 2.5 wt-% to about 6 wt-% of cobalt and about 7 wt-% to about 10 wt-% of molybdenum.

15. The process of claim 12, wherein the second hydroprocessing treatment step utilizes a hydrocracking/ring hydrogenation catalyst comprising a sulfided metal catalyst system.

16. The process of claim 15, wherein the sulfided metal catalyst system has a formula of $MMo/SiO_2$-$Al_2O_3$ or $MW/SiO_2$-$Al_2O_3$, where M is selected from the group consisting of Co, Ni, Ru, Ir, Pt, Fe, Rh, Pd, Cr, and Re.

17. The process of claim 15, wherein the sulfided metal catalyst system is selected from the group consisting of $NiW/SiO_2$-$Al_2O_3$, $NiMo/SiO_2$-$Al_2O_3$, $CoMo/SiO_2$-$Al_2O_3$, $FeMo/SiO_2$-$Al_2O_3$, and combinations thereof.

18. The process of claim 12, wherein the first hydroprocessing treatment step produces a substantially benzene-free mixture comprising $C_7$–$C_{10}$ alkylbenzenes.

19. The process of claim 12, wherein the second hydroprocessing treatment step is performed at a temperature from about 350° C. to about 390° C. and at a hydrogen pressure of from about 1900 psig to about 2800 psig.

20. The process of claim 19, wherein the second hydroprocessing treatment step is moderated and controlled by reducing the hydrogen pressure and reaction time to produce a partially hydrogenated reformulated gasoline product containing a concentration of about 25 wt-% or less of alkylbenzenes.

21. The process of claim 12, wherein the second hydroprocessing treatment step is performed at a temperature from about 385° C. to about 390° C. and a hydrogen pressure of from about 2200 psig to about 2800 psig.

22. The process of claim 1, wherein the reformulated hydrocarbon gasoline product comprises compounds belonging to the group consisting of monoalkylcyclohexane, dialkylcyclohexanes, trialkylcyclohexanes, tetraalkylcyclohexanes, monoalkylcyclopentane, dialkylcyclopentanes, trialkylcyclopentanes, tetraalkylcyclopentanes, multibranched paraffins, $C_7$–$C_{10}$ alkylbenzenes, and mixtures thereof.

23. The process of claim 1, wherein the reformulated gasoline product is a mixture comprising multibranched paraffins, benzene-free $C_7$–$C_{10}$ alkylbenzenes in a total concentration of 25 wt % or less, and di- and trialkylsubstituted naphthenes.

24. The process of claim 1, further comprising the step of mixing an oxygenated additive with the reformulated hydrocarbon gasoline product to augment the efficiency and improve the combustion properties of the gasoline product.

25. The process of claim 24, wherein the oxygenated additive is an alkyl t-alkyl ether which is present in an amount of at least about 2 wt-% with respect to the reformulated hydrocarbon gasoline product.

26. The process of claim 24, wherein the oxygenated additive is selected from the group consisting of methyl t-butyl ether, ethyl t-butyl ether, methyl t-pentyl ether, ethanol, and mixtures thereof.

27. A process for converting lignin into reformulated hydrocarbon gasoline, comprising the steps of:

(a) providing a lignin material including water;

(b) reacting the lignin material with an alcoholic solution of an alkali metal hydroxide in a base-catalyzed depolymerization reaction to produce a depolymerized lignin product comprising compounds belonging to the group consisting of alkylated phenols, alkylated alkoxyphenols, hydrocarbons, and mixtures thereof, and (c) subjecting the depolymerized lignin product to a hydroprocessing reaction comprising the steps of:

(i) contacting the depolymerized lignin product with a hydrodeoxygenation catalyst in a first hydroprocessing treatment to produce a hydrodeoxygenated intermediate product; and (ii) contacting the hydrodeoxygenated intermediate product with a hydrocracking/ring hydrogenation catalyst in a second hydroprocessing treatment to produce a reformulated hydrocarbon gasoline product comprising compounds belonging to the group consisting of monoalkylcyclohexane, dialkylcyclohexanes, trialkylcyclohexanes, tetraalkylcyclohexanes, monoalkylcyclopentane, dialkylcyclopentanes, trialkylcyclopentanes, tetraalkylcyclopentanes, multibranched paraffins, $C_7$–$C_{10}$ alkylbenzenes, and mixtures thereof.

28. The process of claim 27, wherein the water in the lignin material is present in an amount from about 10 wt-% to about 200 wt-% with respect to the weight of the lignin material.

29. The process of claim 27, wherein the alcoholic solution includes methanol or ethanol.

30. The process of claim 27, wherein the alkali metal hydroxide is sodium hydroxide or potassium hydroxide.

31. The process of claim 29, wherein the alkali metal hydroxide is dissolved in methanol or ethanol in a concentration from about 5 wt-% to about 10 wt-%.

32. The process of claim 27, wherein the depolymerization reaction is carried out in a temperature range from about 250° C. to about 310° C.

33. The process of claim 27, wherein the depolymerization reaction time is from about 30 seconds to about 15 minutes.

34. The process of claim 27, wherein the hydroprocessing reaction is carried out in a temperature range from about 350° C. to about 390° C.

35. The process of claim 27, wherein the hydrodeoxygenation catalyst comprises a sulfided $CoMo/Al_2O_3$ catalyst system.

36. The process of claim 27, wherein the hydrocracking/ring hydrogenation catalyst comprises a sulfided metal catalyst system having a formula of $MMo/SiO_2$-$Al_2O_3$ or $MW/SiO_2$-$Al_2O_3$, where M is selected from the group consisting of Co, Ni, Ru, Ir, Pt, Fe, Rh, Pd, Cr, and Re.

37. The process of claim 36, wherein the sulfided metal catalyst system is selected from the group consisting of $NiW/SiO_2$-$Al_2O_3$, $NiMo/SiO_2$-$Al_2O_3$, $CoMo/SiO_2$-$Al_2O_3$, $FeMo/SiO_2$-$Al_2O_3$, and combinations thereof.

38. The process of claim 27, wherein the first hydroprocessing treatment produces a substantially benzene-free mixture comprising $C_7$–$C_{10}$ alkylbenzenes.

39. The process of claim 27, wherein the second hydroprocessing treatment is performed at a temperature from about 350° C. to about 390° C. and at a hydrogen pressure of from about 1900 psig to about 2800 psig.

40. The process of claim 27, further comprising the step of mixing an oxygenated additive with the reformulated hydrocarbon gasoline product to augment the efficiency and improve the combustion properties of the gasoline product.

* * * * *